US007090213B2

(12) United States Patent
Suzuki et al.

(10) Patent No.: US 7,090,213 B2
(45) Date of Patent: Aug. 15, 2006

(54) OUTLET ROLLER OF SHEET STACKING DEVICE AND AN IMAGE FORMING APPARATUS INCLUDING THE SAME

(75) Inventors: Nobuyoshi Suzuki, Tokyo (JP); Shinji Asami, Saitama (JP); Junichi Iida, Kanagawa (JP); Hiroki Okada, Kanagawa (JP); Hiromoto Saitoh, Kanagawa (JP); Takeshi Sasaki, Tokyo (JP); Kenji Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 3 days.

(21) Appl. No.: 10/101,741

(22) Filed: Mar. 21, 2002

(65) Prior Publication Data

US 2002/0135119 A1 Sep. 26, 2002

(30) Foreign Application Priority Data

Mar. 22, 2001 (JP) ..... 2001-083248
Feb. 28, 2002 (JP) ..... 2002-053395

(51) Int. Cl.
*B65H 37/04* (2006.01)

(52) U.S. Cl. ..... 270/58.11; 270/58.08; 399/410; 271/198; 271/207; 271/306

(58) Field of Classification Search ..... 270/58.08, 270/58.11, 58.13, 58.14, 58.18, 58.12, 58.16; 399/410; 271/250, 226, 198, 199, 306, 218, 271/285, 286, 148, 189, 220, 207
See application file for complete search history.

(56) References Cited

U.S. PATENT DOCUMENTS 4,546,964 A * 10/1985 Linthout ..... 271/250
5,020,784 A 6/1991 Asami et al.
5,263,697 A 11/1993 Yamazaki et al.
5,320,336 A 6/1994 Asami
5,443,249 A * 8/1995 Rizzolo et al. ..... 270/58.08
5,508,798 A 4/1996 Yamada
5,513,839 A * 5/1996 Green ..... 270/58.07
5,570,877 A 11/1996 Asami et al.

(Continued)

FOREIGN PATENT DOCUMENTS

JP 07-010345 1/1995

(Continued)

OTHER PUBLICATIONS

U.S. Appl. No. 10/101,741, filed Sep. 26, 2002, Suzuki et al.

(Continued)

*Primary Examiner*—Patrick Mackey
(74) *Attorney, Agent, or Firm*—Oblon, Spivak, McClelland, Maier & Neustadt, P.C.

(57) ABSTRACT

A sheet stacking device of the present invention includes a receipt tray for stacking sheets sequentially driven out by an outlet roller. The outlet roller has a cylindrical portion and a conveying portion, which is contiguous with the end face of the cylindrical portion facing the center of the sheets, for exerting a conveying force on the sheets. The conveying portion has a circumference greater in diameter than the cylindrical portion and contacts the sheets at a position deviated from a staple bound the sheets.

45 Claims, 8 Drawing Sheets

U.S. PATENT DOCUMENTS

| | | | | |
|---|---|---|---|---|
| 5,655,765 | A | | 8/1997 | Asami et al. |
| 5,692,411 | A | | 12/1997 | Tamura |
| 5,741,009 | A | * | 4/1998 | Kawano et al. ..... 271/182 |
| 5,762,328 | A | | 6/1998 | Yamada et al. |
| 5,788,229 | A | | 8/1998 | Asami et al. |
| 6,145,825 | A | | 11/2000 | Kunihiro et al. |
| 6,199,853 | B1 | | 3/2001 | Andoh et al. |
| 6,231,045 | B1 | | 5/2001 | Yamada et al. |
| 6,264,191 | B1 | | 7/2001 | Suzuki et al. |
| 6,296,247 | B1 | | 10/2001 | Tamura et al. |
| 6,322,070 | B1 | | 11/2001 | Yamada et al. |
| 6,343,785 | B1 | | 2/2002 | Yamada et al. |
| 6,375,181 | B1 | * | 4/2002 | Kawano et al. ..... 270/58.12 |
| 6,394,448 | B1 | | 5/2002 | Suzuki et al. |
| 6,561,503 | B1 | * | 5/2003 | Ogata et al. ..... 270/58.12 |
| 2002/0135119 | A1 | | 9/2002 | Suzuki et al. |

FOREIGN PATENT DOCUMENTS

| | | | | |
|---|---|---|---|---|
| JP | 11263494 | A | * | 9/1999 |
| JP | 2000-053300 | | | 2/2000 |
| JP | 2000-86056 | | | 3/2000 |
| JP | 2000281259 | A | * | 10/2000 |
| JP | 2000-327199 | | | 11/2000 |

OTHER PUBLICATIONS

U.S. Appl. No. 11/267,403, filed Nov. 7, 2005, Tokita et al.
U.S. Appl. No. 11/273,301, filed Nov. 15, 2005, Iida et al.

* cited by examiner

OUTLET ROLLER OF SHEET STACKING DEVICE AND AN IMAGE FORMING APPARATUS INCLUDING THE SAME

BACKGROUND OF THE INVENTION

1. Field of the Invention

The present invention relates to a method of stacking sheets sequentially discharged, a device for practicing the same, a sheet finisher using the device, and an image forming apparatus using the sheet finisher.

2. Description of the Background Art

It is a common practice with a copier, printer or similar image forming apparatus to staple or otherwise finish sheets carrying images thereon with a sheet finisher while discharging the finished sheets to a receipt tray or similar sheet stacking device. The sheet stacking device should be configured to stack a large number of stapled sheet stacks. However, the problem with the sheet stacking device is that staples sequentially piled up on the device raise the stacks and cause the top of the stacks to contact an outlet roller. The outlet roller contacting the top sheet stack is apt to catch it and disturb the sheets or, in the worst case, damage the sheets or cause them to drop. While the number of sheet stacks to be loaded on the sheet stacking device may be reduced for solving the above problem, this kind of scheme lowers productivity and cannot meet users' needs.

Further, the outlet roller constantly contacting the top sheet stack makes it impossible to pile further sheet stacks. As a result, the amount of sheets that can be stacked on the sheet stacking device is determined by the height of sheet stacks at the side where staples are positioned.

In light of the above, a receipt tray formed with concavity corresponding in position to a pile of staples has been proposed in the past. Although such a receipt tray may prevent a pile of staples from raising the sheet stacks, it is problematic when it comes to multistapling that is predominant today. More specifically, multistapling causes staples to be piled up at both sides of the trailing edges of sheet stacks. Moreover, to deal with various sheet sizes, the concavity must occupy major part of the trailing edge portion of the receipt tray for accommodating the piles of staples, resulting in irregular stacking or the drop of sheet stacks.

Japanese Patent Laid-Open Publication No. 2000-143082 discloses a method that shifts consecutive sheet stacks one by one for thereby preventing staples from raising the sheet stacks. This method has a problem that when curled sheets are stacked by being shifted to the side raised by staples, the raised side is further raised.

Technologies relating to the present invention are also disclosed in, e.g., Japanese Patent Laid-Open Publication Nos. 2000-86056 and 2000-327199.

SUMMARY OF THE INVENTION

It is an object of the present invention to provide a sheet stacking method not preventing the top of sheet stacks raised by a pile of staples from contacting an outlet roller, but allowing the top of sheet stacks to safely contact the outlet roller without any problem, a device for practicing the same, a sheet finisher using the device, and an image forming apparatus using the sheet finisher.

It is another object of the present invention to provide a sheet stacking method capable of stacking sheet stacks to a stable level without causing a conveying portion to catch staples, a device for practicing the same, a sheet finisher using the device, and an image forming apparatus using the sheet finisher.

It is another object of the present invention to provide a sheet stacking device capable of efficiently scattering stapled sheet stacks to thereby reduce the rise of sheet stacks and increase the amount of sheet stacks to be loaded, a device for practicing the same, a sheet finisher using the device, and an image forming apparatus using the sheet finisher.

A sheet stacking device of the present invention includes a receipt tray for stacking sheets sequentially driven out by an outlet roller. The outlet roller has a cylindrical portion and a conveying portion, which is contiguous with the end face of the cylindrical portion facing the center of the sheets, for exerting a conveying force on the sheets. The conveying portion has a circumference greater in diameter than the cylindrical portion and contacts the sheets at a position deviated from a staple bound the sheets.

A sheet finisher using the above sheet stacking device and an image forming apparatus using the sheet finisher are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
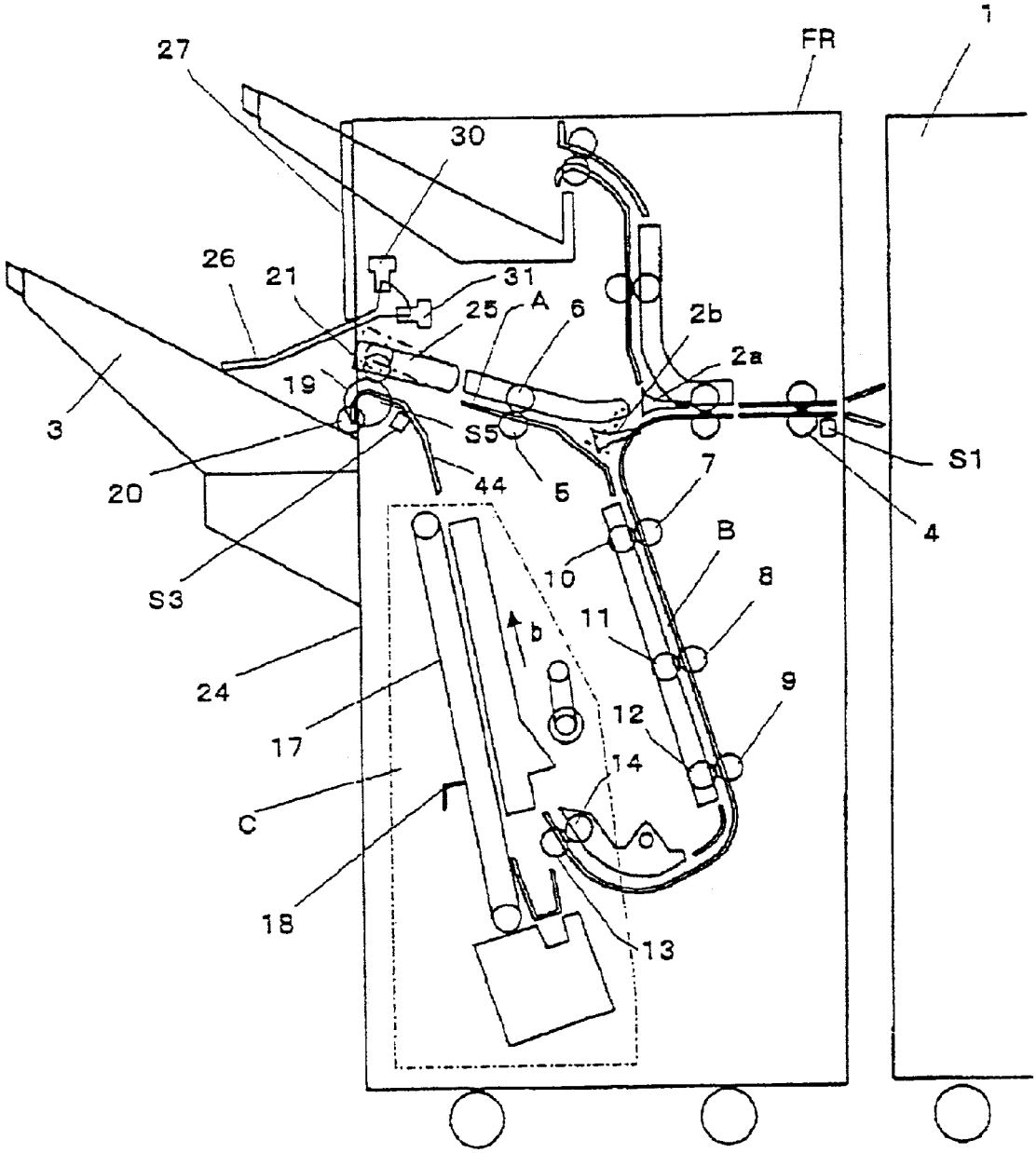
FIG. 1 is an elevation showing a sheet stacking device embodying the present invention and applied to a sheet finisher for an image forming apparatus.
Figure 2:
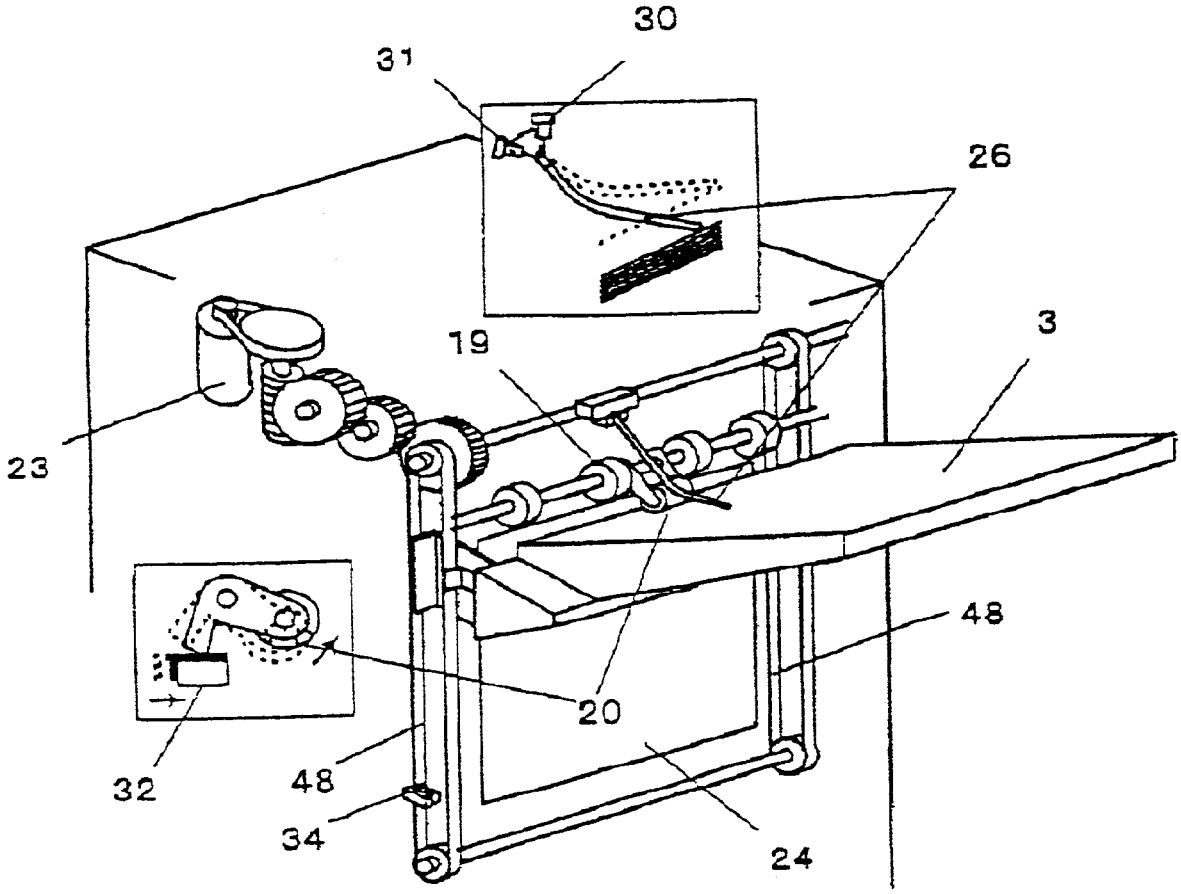
FIG. 2 is a perspective view showing the sheet stacking device in detail.

Referring to FIG. 1 of the drawings, a sheet finisher FR including a sheet stacking device embodying the present invention is shown. FIG. 2 shows the sheet stacking device in detail. As shown, the sheet finisher FR is operatively connected to one side of a copier, printer or similar image forming apparatus 1. The sheet finisher FR has a sheet inlet communicated to the sheet outlet, not shown, of the image forming apparatus. An inlet sensor S1, an inlet roller pair 4 and two path selectors 2*a* and 2*b* are arranged around the sheet inlet. The inlet sensor S1 is responsive to a sheet entering the sheet finisher FR. The inlet roller pair 4 conveys the sheet into the sheet finisher FR.

The path selectors 2*a* and 2*b* steer the sheet entering the sheet finisher FR to either one of a path A terminating at a receipt tray 3 and a path B terminating at a staple unit C. A stack of sheets stapled by the staple unit C is also delivered to the receipt tray 3, which is positioned at the most downstream side. A solenoid, spring or similar actuator is assigned to each of the path selectors 2*a* and 2*b*.

A plurality of drive rollers 5 and a plurality of driven rollers 6 are arranged on the path A in pairs. An outlet roller 19 is positioned on the path A downstream of the roller pairs 5 and 6. Further, an outlet guide 44 is positioned on the path A between the roller pairs 5 and 6 and the outlet roller 19. A driven roller 21 follows the rotation of the outlet roller 19. The path A guides the sheet entered the sheet finisher straight to the receipt tray 3. The driven roller 21 is rotatably mounted on the free end of a pivotable plate 25. A plurality of drive rollers 7, 8 and 9 and a plurality of driven rollers 10, 11 and 12 are also arranged on the path B in pairs. Part of the path B downstream of the roller pair 9 and 12 is bent in the form of a letter U. A drive roller 13 and a driven roller 14 are positioned at the bent part of the path B for conveying the sheet to the staple unit C in cooperation.

The image forming apparatus includes a scanning unit, an image writing unit, an image forming unit, a sheet feeding unit, and a sheet discharging unit although not shown specifically. The scanning unit includes a first and a second scanner movable in the subscanning direction. When the scanners scan a document while moving in the subscanning direction, the resulting reflection from the document is incident to a CCD (Charge Coupled Device) array or similar image sensor via optics. The image sensor outputs an image signal representative of a document image. The image signal is converted to image data and then written to a memory or storing means.

In the image writing unit, a laser beam issuing from a semiconductor laser (laser diode or LD) and modulated in accordance with the image data scans the surface of a photoconductive drum included in the image forming unit. As a result, a latent image corresponding to the document image is formed on the drum.

The image forming unit includes a charger, a developing unit, an image transferring unit, a peeler, a cleaner, a discharge lamp and other conventional process units for electrophotography. The charger uniformly charges the surface of the drum. The developing unit develops the latent image formed on the charged surface of the drum with toner, thereby producing a corresponding toner image. The image transferring unit transfers the toner image to a sheet or recording medium. The peeler peels the sheet carrying the toner image off the drum. The fixing unit fixes the toner image on the sheet. The sheet feeding unit includes a plurality of sheet trays and pays out the sheet from designated one of the sheet trays to a vertical path. The sheet is conveyed along the vertical path to a nip between the drum and the image transferring unit.

The sheet discharging unit drives the sheet coming out of the fixing unit out of the image forming apparatus. In the illustrative embodiment, the sheet discharging unit conveys the sheet toward the inlet roller pair 4. Such a configuration of the image forming apparatus is conventional and will not be described specifically.

The sheet finisher FR is selectively operable in a sort/stack mode for simply sorting or stacking consecutive sheets on the receipt tray 3 or in a staple mode for sequentially stapling stacks of sheets, as will be described specifically hereinafter In the sort/stack mode, the path selectors 2*a* and 2*b* are positioned as indicated by solid lines in FIG. 1. The path selectors 2*a* and 2*b* steer a sheet entering the sheet finisher FR via the inlet roller pair 4 to the path A face down, i.e., with the image surface of the sheet facing downward. The drive roller 5 and driven roller 6 on the path A convey the sheet toward the receipt tray 3. The outlet driven roller 21 is constantly pressed against the outlet drive roller 19 by, e.g., its own weight or a spring. These rollers 19 and 21 therefore drive the sheet out of the sheet finisher FR to the receipt tray 3. After the trailing edge of the sheet has moved away from the rollers 19 and 21, a return roller 20 causes the trailing edge of the sheet to abut against a rear fence 24 mounted on the receipt tray 3. As a result, the sheet is neatly positioned on the receipt tray 3. The return roller 20 is formed of sponge. Consecutive sheets are sequentially stacked on the receipt tray 3 until a feeler 26 and sensors 30 and 31 sense the top of sheet stacks. This maintains the top of the sheet stacks within a preselected range of height at all times.

When the receipt tray 3 becomes full, a lower limit sensor 34 shown in FIG. 2 senses the lowermost position of the receipt tray 34. More specifically, as shown in FIG. 2, the receipt tray 3 is affixed to a pair of lift belts 48. A belt motor 23, which is rotatable in opposite directions, causes the lift belts 48 to selectively move upward or downward via a gear train and timing belts. When the receipt tray 3 being lifted by the lift belts 48 pushes the return roller 20 upward, an upper limit switch 32 shown in FIG. 2 turns off. In response, the belt motor 23 stops rotating to thereby protect the receipt tray 3 from damage ascribable to overrunning. To sort the consecutive sheets, the receipt tray 3 is movable in the direction perpendicular to the direction of sheet discharge.

On the other hand, in the staple mode, the path selector 2*b* is switched to a position indicated by a phantom line in FIG. 1. The path selector 2*b* therefore steers the sheet entering the sheet finisher FR to the path B terminating at the staple unit C. The staple unit C jogs the consecutive sheets sequentially fed thereto and then staples them together. A discharge belt 17 extends in a sheet discharge section indicated by an arrow b in FIG. 1. The discharge belt 17 and a hook 18 affixed thereto, which move together in the direction b, convey the stapled sheet stack toward the outlet drive roller 19. The outlet drive roller 19 cooperates with the outlet driven roller 21 to convey the stapled sheet stack to the receipt tray 3. Again, the return roller 20 in rotation causes the trailing edge of the stapled sheet stack to abut against the rear fence 24.

Stapled sheet stacks are sequentially driven out from the staple unit C to the receipt tray 3 up to a preselected number of sheets. Consequently, the top of the sheet stacks always remains at a preselected level in the same manner as in the sort/stack mode.

Figure 3:
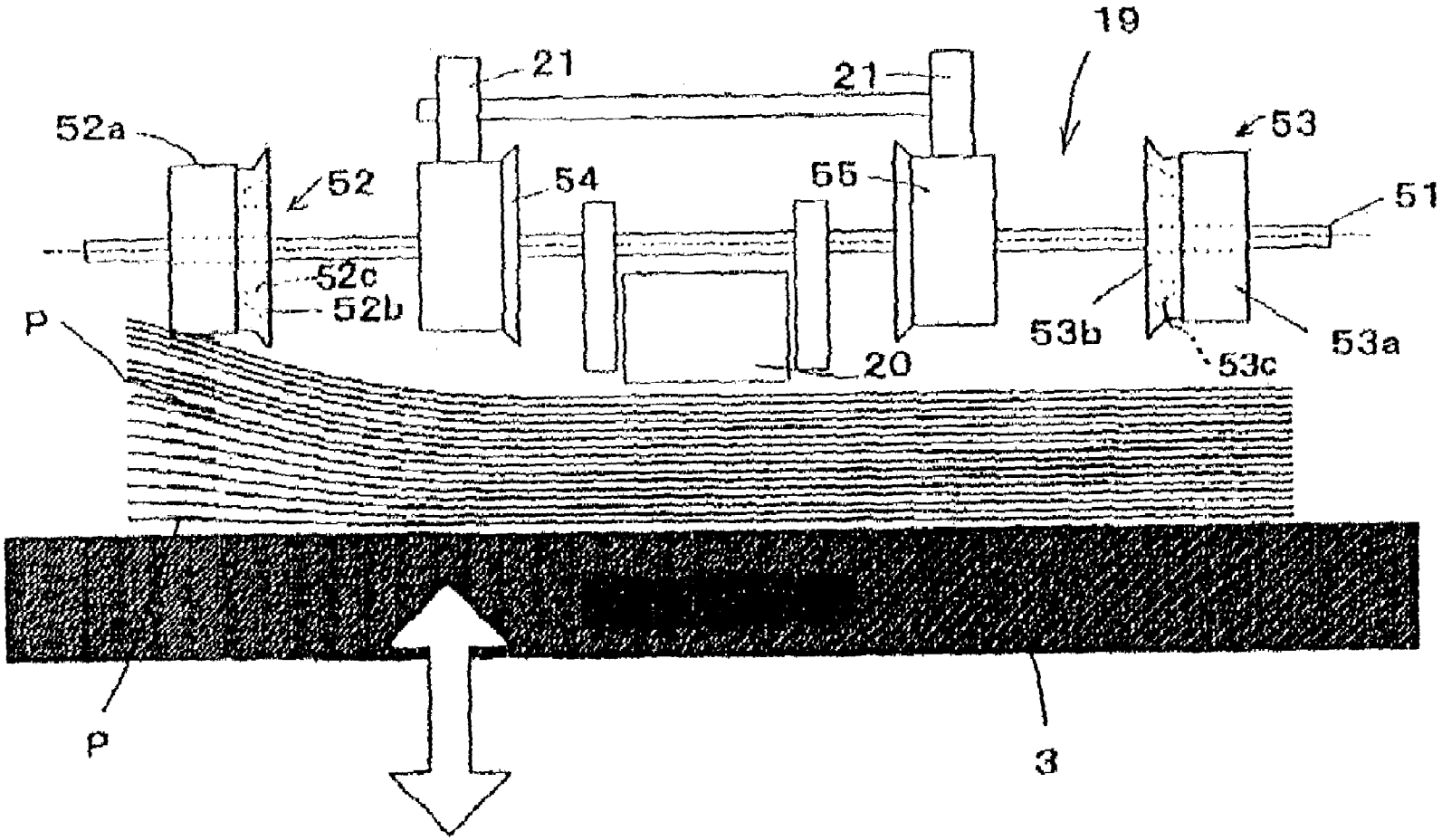
FIG. 3 is a view showing a specific configuration of an outlet roller included in the sheet stacking device.
Figure 4:
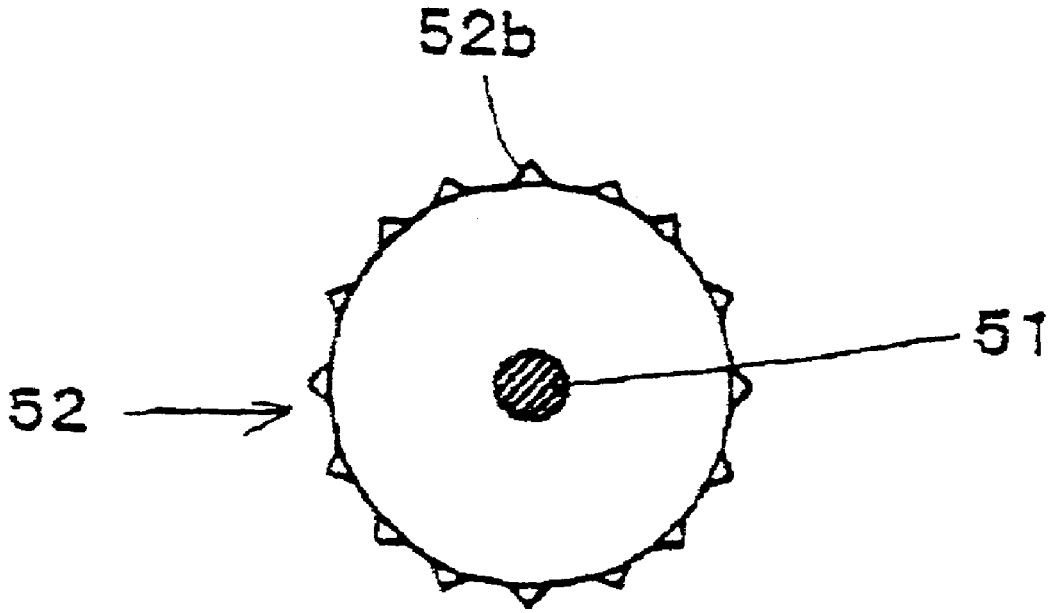
FIG. 4 is a side elevation showing an outer roller forming part of the outlet roller.
Figure 5:
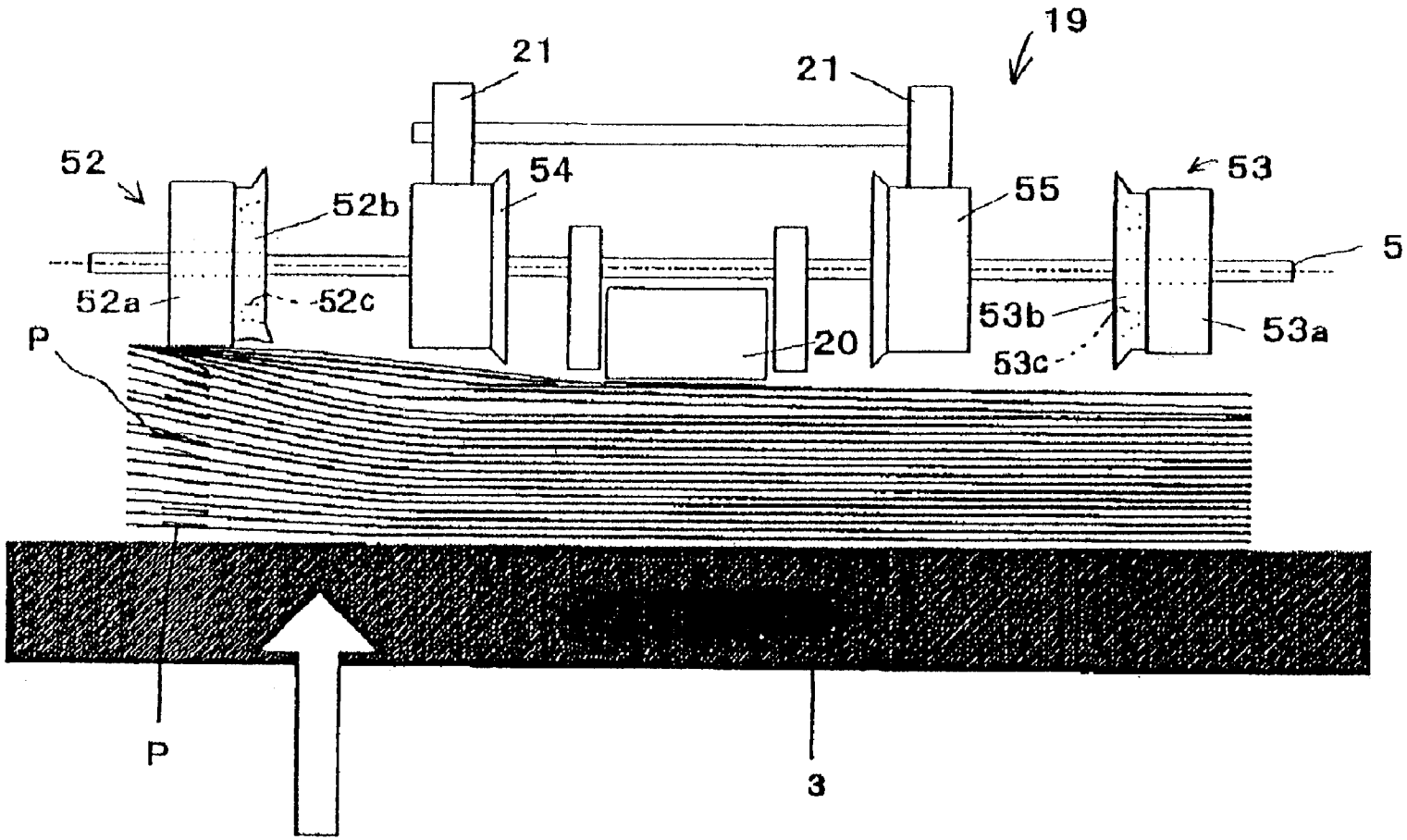
FIG. 5 is a view demonstrating how the outlet roller compresses sheet stacks.

Reference will be made to FIGS. 3 through 5 for describing the outlet drive roller or outlet roller 19 in detail. As shown in FIG. 3, the drive roller 19 is made up of a shaft 51, a pair of outer rollers 52 and 53, and a pair of inner rollers 54 and 55. The outer rollers 52 and 53 are mounted on opposite end portions of the shaft 51 while the inner rollers 54 and 55 are mounted on the shaft 51 between the outer rollers 52 and 53. The outer roller 52 has a cylindrical portion 52*a* and a conveying portion 52*b* greater in diameter than the cylindrical portion 52*a*. The conveying portion 52*b* is positioned inward of the cylindrical portion 52*a* in the axial direction of the shaft 51 and protrudes outward of the circumference of the cylindrical portion 52*a* in the radial direction. Likewise, the outer roller 53 has a cylindrical portion 53*a* and a conveying portion 53*b* identical in configuration with the above two portions 52*a* and 52*b*, respectively. The conveying portions 52*b* and 53*b* scratch away the leading edge portions of sheets downward.

The cylindrical portions 52*a* and 53*a* are formed of hard synthetic resin having a small coefficient of friction. The conveying sections 52*b* and 53*b* are formed of rubber or similar elastic material having a great coefficient of friction, and each have a hollow configuration. As shown in FIG. 4, the conveying portions 52*b* and 53*b* each have a toothed circumference at the end portion facing the cylindrical portion 52*a* or 53*a*, respectively, in the axial direction. Concavities 52*c* and 53*c* are respectively formed in the end faces of the conveying portions 52*b* and 53*b*, allowing the conveying portions 52*b* and 53*b* to easily elastically deform. Therefore, when a given load acts on the hollow conveying portion 52*a* or 52*b*, the conveying portion 52*a* or 52*b* subjected to the load elastically yields and does not obstruct sheet conveyance.

The outer rollers 52 and 53 are mounted on the shaft 51 at positions satisfying the following conditions. Assume that sheets of size A4 (or letter size) are fed in a landscape position and stapled by the staple unit C at one corner thereof. Then, the conveying portion 52*b* or 53*b* corresponding in position to a staple P is positioned inward of the outer end of the staple P. Assume that the sheets of size A4 (or letter size) to be stapled are fed in a profile position. Then, the conveying portion or 53*b* corresponding to the staple P is positioned outside of the width of the sheets. It is to be noted that size A4 and letter size are simply specific sizes that the staple unit C can staple.

Figure 6:
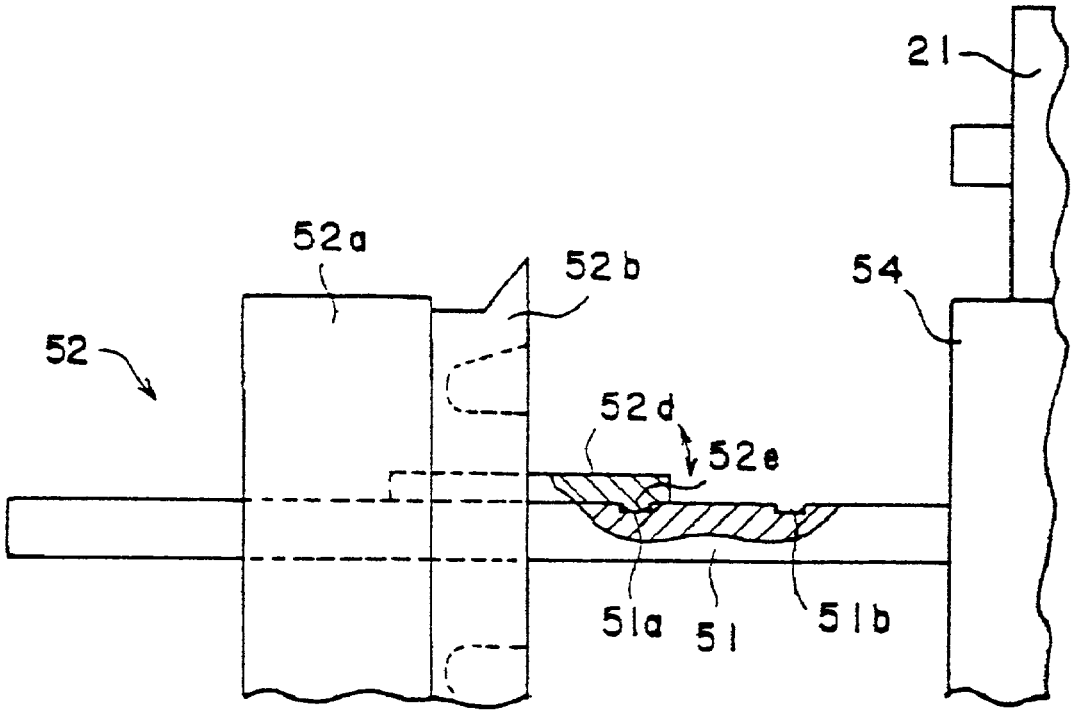
FIG. 6 is a view showing another specific configuration of the outlet roller.

FIG. 6 shows another specific configuration that allows the rollers 52 and 53 to be shifted on the shaft 51 in accordance with sheet size to be dealt with. As shown, grooves 51*a* and 51*b* are formed in the shaft 51 at spaced locations in the axial direction of the shaft 51. An arm 52*d* extends out from the intermediate portion of the outer roller 52 (or 53) along the shaft 51. The axially inner end 52*e* of the arm 52*d* is so configured as to elastically mate with either one of the grooves 51*a* and 51*b*. In this configuration, the outer roller 52 can be shifted to a position determined by the groove 51*a* or 51*b* in the axial direction of the shaft 51 and locked there. The grooves 51*a* and 51*b* correspond to, e.g., size A4 or letter size and size B5, respectively. The grooves 51*a* and 51*b* satisfy the previously stated conditions required of the rollers 52 (or 53).

In the specific configuration shown in FIG. 6, the arm 52*d* is formed of an elastic material and has a semispherical end 52*e*. The grooves 55*a* and 51*b* each have a rectangular cross-section. The end 52*e* of the arm 52*d* therefore easily slips out of the groove 51*a* or 51*b* and then clicks into the other groove 51*b* or 51*a* only if the operator slightly pushes the roller 52 in the axial direction of the shaft 51. It follows that the roller 52 can be easily adjusted in position in matching relation to sheet size. In addition, the operator can surely feel the clicking action of the arm 52*d*. The circumference of the shaft 51 should preferably be partly cut off in the form of a letter D for allowing the roller 52 to surely rotate integrally with the shaft 51.

The inner rollers 54 and 55 are formed of rubber or similar elastic material having a great coefficient of friction. An annular projection protrudes from the inner edge of each inner roller 54 or 55 in the axial direction of the shaft 51. The inner rollers 54 and 55 each are pressed by the previously mentioned driven roller 21 as usual. No driven rollers are associated with the outer rollers 52 and 53.

The cylindrical portions 52*a* and 53*a* of the outer rollers 52 and 53 are formed of hard resin, as stated above. Assume that after the leading edge of a stapled sheet stack being driven out has landed on the receipt tray 3, the tray 3 is lowered by a preselected amount to receive the trailing edge of the sheet stack and then lifted. At this instant, even if the portion of the sheet stack bound by the staple P and therefore higher in level than the other portion contacts the outer roller 52 or 53, the cylindrical portion 52*a* or 53*a* prevents the roller 52 or 53 from catching the sheet stack. The receipt tray 3 can therefore be stably loaded with a large number of stapled sheet stacks to the preselected height.

The hollow conveying portions 52*b* and 53*b* are formed of rubber or similar material having a great coefficient of friction, as also stated earlier. The conveying portions 52*b* and 53*b* therefore elastically yield inward toward the shaft 51 when subjected to a given load. In this sense, the conveying portions 52*b* and 53*b* contribute to the conveyance of a sheet stack while obviating skew.

More specifically, assume that the conveying portion 52*b* or 52*c* contacts the stapled, raised portion of a sheet stack when the receipt tray 3 is rising after the receipt of the trailing edge of the sheet stack. Then, as shown in FIG. 5, the circumference of the conveying portion 52*b* or 52*c* contacting the sheet stack yields because the cylindrical portion 52*a* or 53*b* associated therewith is formed of hard resin. This allows staples P to be randomly positioned on the receipt tray 3 and therefore further promotes stable stacking of stapled sheets on the tray 3.

Figure 7:
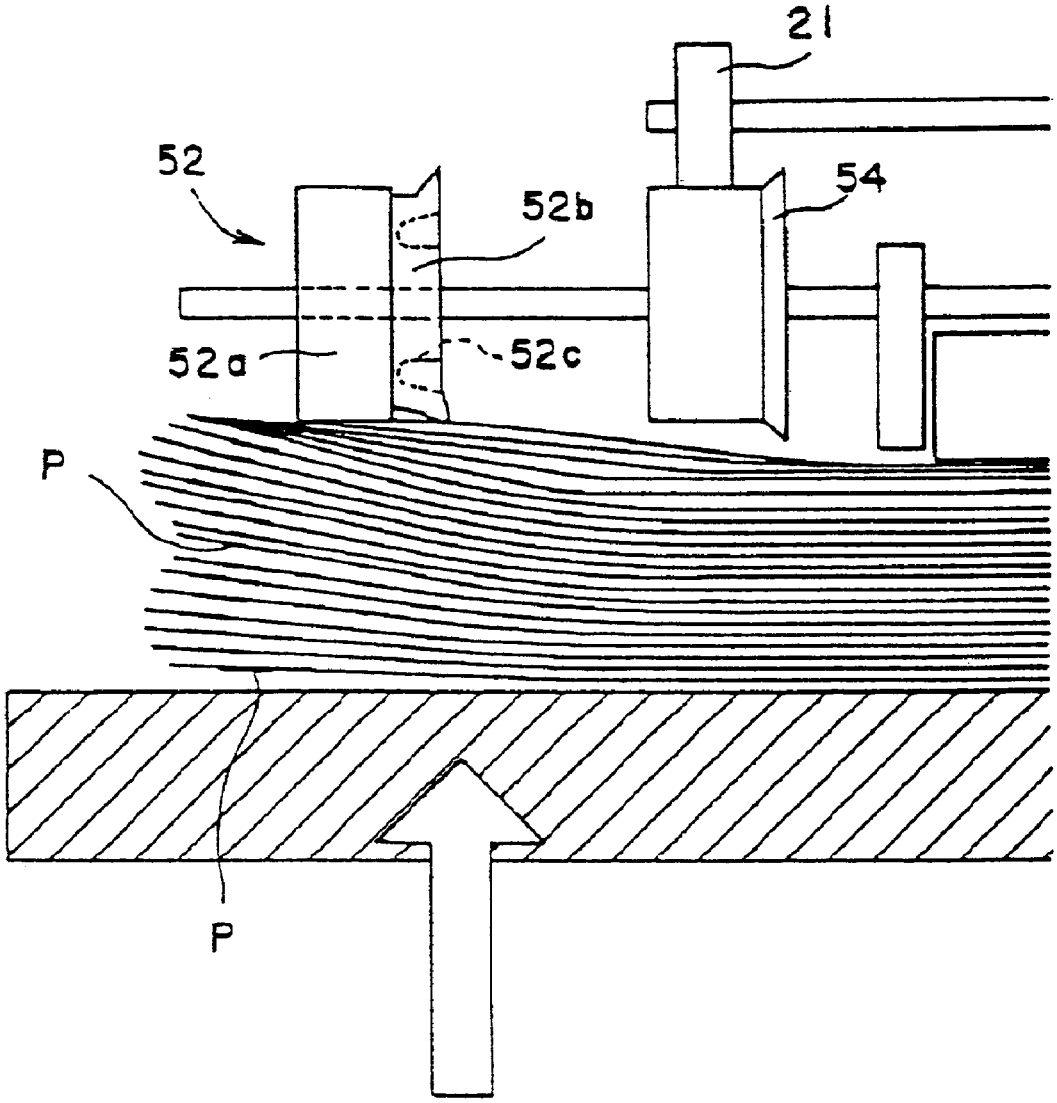
FIG. 7 shows a condition in which sheet stacks are shifted from each other due to a pile of staples.

In the above configuration, when a stapled sheet stack is driven out to the receipt tray, a staple P bound the sheet stack contacts the cylindrical portion 52*a* of the outer roller 52, as shown in FIG. 3, and is pressed thereby, as shown in FIG. 5. At this instant, the staples P each protruding from the respective sheet stack interfere with each other. As a result, as shown in FIG. 7, the staples are shifted from each other and therefore lower the total height of the sheet stacks. This further increases the number of sheet stacks that can be loaded on the receipt tray 3.

Figure 8:
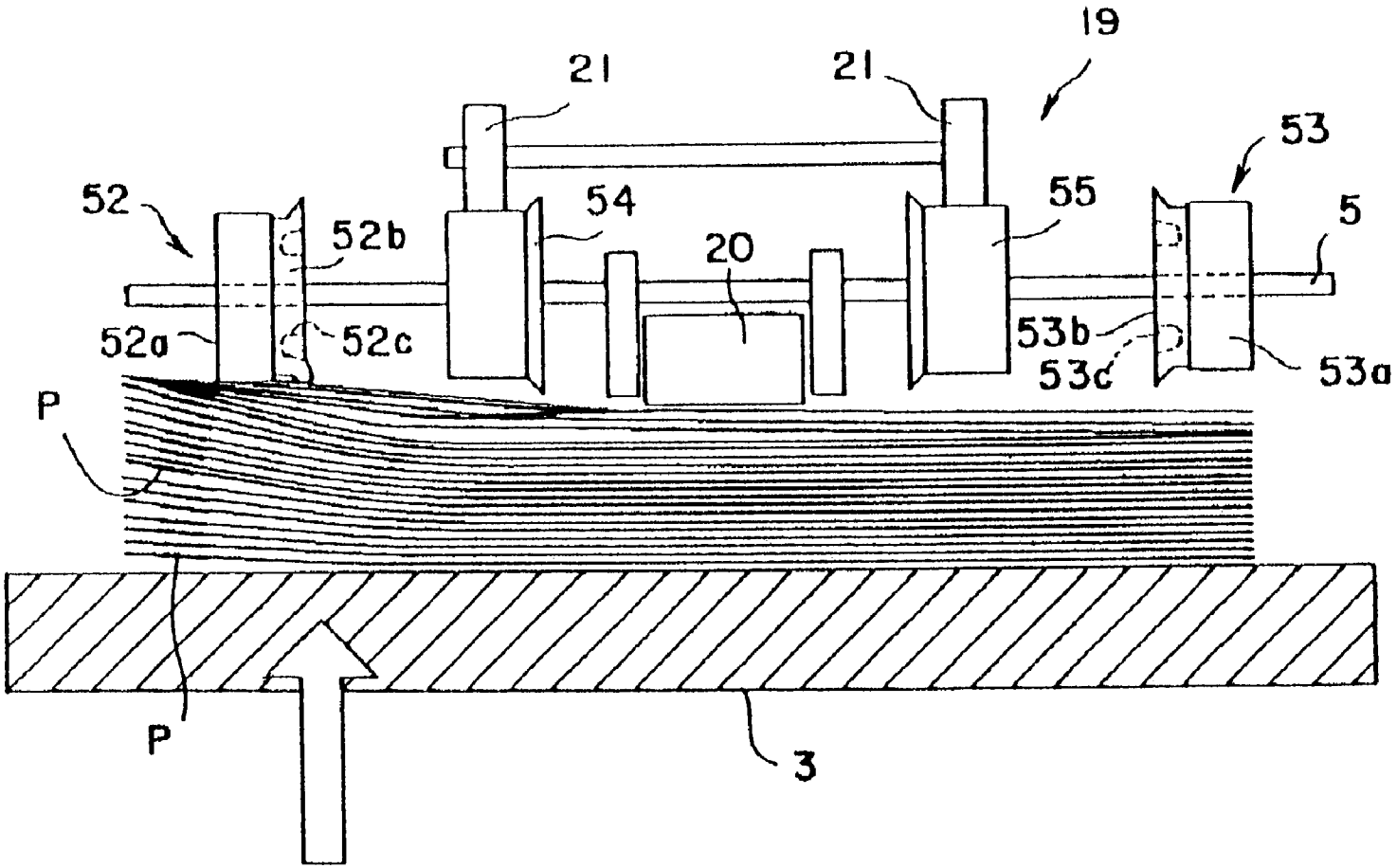
FIG. 8 shows a condition in which a cylindrical portion forming part of the outer roller contacting the top of sheet stacks at a position inward of staples.

As shown in FIG. 8, considering the above shift of the staples P, an arrangement may be made such that the cylindrical portion 52*a* of the outer roller 52 contacts the top of the sheet stacks at a position further inward of the staples P. In this condition, the cylindrical portion 52 contacts the portion of the sheet stacks inclined due to the pile of staples P. The cylindrical portion 52 therefore force the sheet stacks in the oblique direction for thereby further efficiently shifting the sheet stacks.

Further, the conveying portions 52*b* and 53*b* are positioned inward of the staple P bound one corner of a stack of sheets of size A4 (letter side) and fed in the landscape position or positioned outside of the width of sheets of size A4 (letter side) and fed in the profile position. The conveying portions 52*b* and 53*b* therefore do not catch the staple P at all. Consecutive sheet stacks can therefore be stably stacked on the receipt tray 3 to the preselected height at all times.

Various modifications will become possible for those skilled in the art after receiving the teachings of the present disclosure without departing from the scope thereof.

What is claimed is:

1. A paper sheet stacking device comprising:

an outlet roller comprising cylindrical and conveying portions and configured to sequentially drive out sheets bounded by a staple at a corner portion thereof, said conveying portion having a circumference greater in diameter than said cylindrical portion and being contiguous with an end face of said cylindrical portion facing a center of said paper sheets and configured to exert a conveying force on said paper sheets; and a receipt tray for stacking said paper sheets, wherein said cylindrical portion has a smaller coefficient of friction with respect to said paper sheets than said conveying portion, and said conveying portion contacts the paper sheets at a position deviated from the staple bounding said paper sheets and said cylindrical portion contacts the staple bounding said paper sheets from above.

2. The device as claimed in claim 1, wherein said cylindrical portion is formed of a hard material.

3. The device as claimed in claim 2, wherein said cylindrical portion is positioned on, but inward of, the staple.

4. The device as claimed in claim 3, wherein the paper sheets are stacked on the receipt tray with a center being used as a reference, said outlet roller is positioned such that said conveying portion is positioned inward of the staple bounding said paper sheets, which are of a size that can be bound and fed in a landscape position, or positioned outside of a width of said paper sheets fed in a profile position.

5. The device as claimed in claim 3, wherein said outlet roller comprises a pair of inner rollers and a pair of outer rollers positioned outward of said pair of inner rollers.

6. The device as claimed in claim 5, wherein at least one of said pair of outer rollers corresponding in position to the staple is adjustable in position in a direction perpendicular to a direction in which said outlet roller conveys the paper sheets.

7. The device as claimed in claim 5, wherein said pair of inner rollers are fixed at preselected positions.

8. The device as claimed in claim 5, wherein said pair of inner rollers are formed of an elastic material.

9. The device as claimed in claim 2, wherein the paper sheets are stacked on the receipt tray with a center being used as a reference, said outlet roller is positioned such that said conveying portion is positioned inward of the staple bounding said paper sheets, which are of a size that can be bound and fed in a landscape position, or positioned outside of a width of said paper sheets fed in a profile position.

10. The device as claimed in claim 2, wherein said outlet roller comprises a pair of inner rollers and a pair of outer rollers positioned outward of said pair of inner rollers.

11. The device as claimed in claim 10, wherein at least one of said pair of outer rollers corresponding in position to the staple is adjustable in position in a direction perpendicular to a direction in which said outlet roller conveys the sheets.

12. The device as claimed in claim 10, wherein said pair of inner rollers are fixed at preselected positions.

13. The device as claimed in claim 10, wherein said pair of inner rollers are formed of an elastic material.

14. The device as claimed in claim 1, wherein a projection protrudes from the circumference of said conveying portion.

15. The device as claimed in claim 14, wherein said projection is hollow and contacts the paper sheets by yielding inward when subjected to a pressure above a preselected pressure.

16. The device as claimed in claim 14, wherein said cylindrical portion is positioned on, but inward of, the staple.

17. The device as claimed in claim 14, wherein said conveying portion contacts the paper sheets at a position deviated from a staple position having a preselected adjustable width.

18. The device as claimed in claim 14, wherein the paper sheets are stacked on the receipt tray with a center being used as a reference, said outlet roller is positioned such that said conveying portion is positioned inward of the staple bounding said paper sheets, which are of a size that can be bound and fed in a landscape position, or positioned outside of a width of said paper sheets fed in a profile position.

19. The device as claimed in claim 18, wherein said outlet roller comprises a pair of inner rollers and a pair of outer rollers positioned outward of said pair of inner rollers.

20. The device as claimed in claim 19, wherein at least one of said pair of outer rollers corresponding in position to the staple is adjustable in position in a direction perpendicular to a direction in which said outlet roller conveys the paper sheets.

21. The device as claimed in claim 19, wherein said pair of inner rollers are fixed at preselected positions.

22. The device as claimed in claim 19, wherein said pair of inner rollers are formed of an elastic material.

23. The device as claimed in claim 1, wherein said conveying portion contacts the paper sheets at a position deviated from a staple position having a preselected adjustable width.

24. The device as claimed in claim 23, wherein the paper sheets are stacked on the receipt tray with a center being used as a reference, said outlet roller is positioned such that said conveying portion is positioned inward of the staple bounding said paper sheets, which are of a size that can be bound and fed in a landscape position, or positioned outside of a width of said paper sheets fed in a profile position.

25. The device as claimed in claim 23, wherein said outlet roller comprises a pair of inner rollers and a pair of outer rollers positioned outward of said pair of inner rollers.

26. The device as claimed in claim 25, wherein at least one of said pair of outer rollers corresponding in position to the staple is adjustable in position in a direction perpendicular to a direction in which said outlet roller conveys the paper sheets.

27. The device as claimed in claim 25, wherein said pair of inner rollers are fixed at preselected positions.

28. The device as claimed in claim 25, wherein said pair of inner rollers are formed of an elastic material.

29. The device as claimed in claim 1, wherein the paper sheets are stacked on the receipt tray with a center being used as a reference, said outlet roller is positioned such that said conveying portion is positioned inward of the staple bounding said paper sheets, which are of a size that can be bound and fed in a landscape position, or positioned outside of a width of said paper sheets fed in a profile position.

30. The device as claimed in claim 29, wherein said outlet roller comprises a pair of inner rollers and a pair of outer rollers positioned outward of said pair of inner rollers.

31. The device as claimed in claim 30, wherein at least one of said pair of outer rollers corresponding in position to the staple is adjustable in position in a direction perpendicular to a direction in which said outlet roller conveys the paper sheets.

32. The device as claimed in claim 30, wherein said pair of inner rollers are fixed at preselected positions.

33. The device as claimed in claim 30, wherein said pair of inner rollers are formed of an elastic material.

34. The device as claimed in claim 1, wherein said outlet roller comprises a pair of inner rollers and a pair of outer rollers positioned outward of said pair of inner rollers.

35. The device as claimed in claim 34, wherein at least one of said pair of outer rollers corresponding in position to the staple is adjustable in position in a direction perpendicular to a direction in which said outlet roller conveys the sheets.

36. The device as claimed in claim 34, wherein said pair of inner rollers are fixed at preselected positions.

37. The device as claimed in claim 34, wherein said pair of inner rollers are formed of an elastic material.

38. The device as claimed in claim 1, wherein said cylindrical portion is positioned on, but inward of, the staple.

39. The device as claimed in claim 38, wherein the paper sheets are stacked on the receipt tray with a center being used as a reference, said outlet roller is positioned such that said conveying portion is positioned inward of the staple bounding said paper sheets, which are of a size that can be bound and fed in a landscape position, or positioned outside of a width of said paper sheets fed in a profile position.

40. The device as claimed in claim 38, wherein said outlet roller comprises a pair of inner rollers and a pair of outer rollers positioned outward of said pair of inner rollers.

41. The device as claimed in claim 40, wherein at least one of said pair of outer rollers corresponding in position to the staple is adjustable in position in a direction perpendicular to a direction in which said outlet roller conveys the paper sheets.

42. The device as claimed in claim 40, wherein said pair of inner rollers are fixed at preselected positions.

43. The device as claimed in claim 40, wherein said pair of inner rollers are formed of an elastic material.

44. A sheet finisher for finishing paper sheets, comprising:

means for finishing the paper sheets conveyed thereto in a preselected mode;

means for driving the paper sheets finished by said means for finishing out of said paper sheet finisher; and a paper sheet stacking device comprising:

an outlet roller comprising cylindrical and conveying portions and configured to sequentially drive out the paper sheets bounded by a staple at a corner portion thereof, said conveying portion having a circumference greater in diameter than said cylindrical portion and being contiguous with an end face of said cylindrical portion facing a center of said paper sheets and configured to exert a conveying force on said paper sheets; and a receipt tray for stacking the paper sheets, wherein said cylindrical portion has a smaller coefficient of friction with respect to said paper than said conveying portion, and said conveying portion contacts the paper sheets at a position deviated from the staple bounding said paper sheets and said cylindrical portion contacts the staple bounding said paper sheets from above.

45. An image forming apparatus comprising:

means for forming a toner image on a paper sheet; and a paper sheet finisher for finishing paper sheets, said paper sheet finisher comprising:

means for finishing the paper sheets conveyed thereto in a preselected mode;

means for driving the paper sheets finished by said means for finishing out of said paper sheet finisher; and a paper sheet stacking device comprising:

an outlet roller comprising cylindrical and conveying portions and configured to sequentially drive out the paper sheets bounded by a staple at a corner portion thereof, said conveying portion having a circumference greater in diameter than said cylindrical portion and being contiguous with an end face of said cylindrical portion facing a center of said paper sheets and configured to exert a conveying force on said paper sheets; and a receipt tray for stacking the paper sheets, wherein said cylindrical portion has a smaller coefficient of friction with respect to said paper sheets than said conveying portion, and said conveying portion contacts the paper sheets at a position deviated from the staple bounding said paper sheets and said cylindrical portion contacts the staple bounding said paper sheets from above.

* * * * *